US007011011B2

(12) United States Patent
Jessberger et al.

(10) Patent No.: US 7,011,011 B2
(45) Date of Patent: Mar. 14, 2006

(54) VACUUM UNIT FOR PRODUCING A STROKE MOVEMENT

(75) Inventors: Thomas Jessberger, Asperg (DE); Heinz Dobusch, Marbach (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/652,560

(22) Filed: Sep. 2, 2003

(65) Prior Publication Data

US 2004/0206232 A1 Oct. 21, 2004

Related U.S. Application Data

(63) Continuation of application No. PCT/EP02/02176, filed on Feb. 28, 2002.

(30) Foreign Application Priority Data

Mar. 2, 2001 (DE) ..... 101 10 237

(51) Int. Cl.
*F16J 3/00* (2006.01)

(52) U.S. Cl. ..... 92/99

(58) Field of Classification Search ..... 92/99
See application file for complete search history.

(56) References Cited

U.S. PATENT DOCUMENTS

| | | | | |
|---|---|---|---|---|
| 3,380,349 A * | 4/1968 | James | 92/100 |
| 3,799,008 A * | 3/1974 | Danek | 92/99 |
| 4,403,538 A * | 9/1983 | Rise | 92/100 |
| 4,669,264 A * | 6/1987 | Kobelt | 60/388 |
| 5,363,743 A * | 11/1994 | Raddatz et al. | 92/98 D |

FOREIGN PATENT DOCUMENTS

DE 196 23 961 12/1997

* cited by examiner

*Primary Examiner*—F. Daniel Lopez
(74) *Attorney, Agent, or Firm*—Crowell & Moring LLP

(57) ABSTRACT

A vacuum unit for producing a stroke movement due to an applied vacuum. The vacuum unit includes a housing, a spring disposed in the housing, a diaphragm and a drive rod arranged on the diaphragm. The drive rod is positioned centrally on the diaphragm and is mounted in a longitudinal guide in the housing.

7 Claims, 2 Drawing Sheets

VACUUM UNIT FOR PRODUCING A STROKE MOVEMENT

CROSS REFERENCE TO RELATED APPLICATIONS

This application is a continuation of international patent application no. PCT/EP02/02176, filed Feb. 28, 2002, designating the United States of America, and published in German as WO 02/070903, the entire disclosure of which is incorporated herein by reference. Priority is claimed based on Federal Republic of Germany patent application no. DE 101 10 237.2, filed Mar. 2, 2001.

BACKGROUND OF THE INVENTION

This invention relates to a vacuum unit for producing a stroke movement by means of an applied vacuum.

German Patent Application DE 196 23 961 A1 discloses a vacuum unit in the form of a pneumatic switching element, which is connected to a vacuum source and has a pressure space in which is situated a control member that is displaceable by a vacuum against the force of a spring element. This control member is connected to an actuating device which extends out of the pressure space. The spring element is arranged outside of the pressure space and acts on the actuating device or may be mounted on an articulated joint situated outside of the pressure space. With this design, it is impossible to implement a guidance of the drive rod via the spring. In addition, there is the risk of the drive rod becoming skewed, so that the diaphragm of the vacuum unit rubs against the housing or comes to rest on it, which can damage the diaphragm. The diaphragm may also become frayed, which can result in failure of the vacuum unit. This results in inaccuracies in transmission of the vacuum to an element to be actuated.

SUMMARY OF THE INVENTION

An object of this invention is to provide an improved vacuum unit for producing a stroke movement.

Another object of the invention is to provide a vacuum unit which overcomes the aforementioned disadvantages.

A further object of the invention is to provide a vacuum unit or pneumatic switching element having a precision guidance.

It is also an object of the invention to provide a vacuum unit or pneumatic switching element which accurately transmits an applied vacuum into a linear or rotational motion.

These and other objects are achieved in accordance with the present invention by providing a vacuum unit for producing a stroke movement due to an applied vacuum, said vacuum unit comprising a housing, a spring situated in said housing, a diaphragm and a drive rod arranged on the diaphragm, wherein the drive rod is centered on the diaphragm and is mounted by a longitudinal guide in the housing of the vacuum unit.

An important aspect of this invention is that the drive rod is centered on the diaphragm and is mounted in the housing of the vacuum unit by a longitudinal guide. Skewing is thus impossible. The longitudinal guide may be designed so that the frictional forces are minor and thus do not interfere with the transmission of the movement.

According to one embodiment of this invention, the longitudinal guide may be provided with a friction or slide bearing, or as an alternative, a linear ball bearing may also be used. The advantage of the linear ball bearing is the extremely low friction and the consequent high precision of the vacuum unit. For the longitudinal guidance, a bearing pin may also be arranged on the cover of the vacuum unit. This bearing pin passes through the compression spring and engages in a borehole in the drive rod, so that the drive rod is guided by this bearing pin. The advantage of this type of longitudinal guide is that the interaction of the two elements, which are located in the clean air part, is not adversely affected by environmental influences.

Another advantage of this invention is that the compression spring may be designed to be more flexible or unstable because buckling is prevented by the guide. In addition, this type of longitudinal guide can also be integrated into small installation spaces because no additional installation space and no additional components are necessary. The bearing of the bearing pin in the drive rod may also be accomplished with a greater play, amounting to several millimeters in particular. Therefore, it is not necessary to use articulated joints, which are used to compensate for rotational movements of a crank.

In another embodiment of this invention, the drive rod may be provided with a thermally expandable element. This creates a vacuum unit which, in addition to the adjustment due to the vacuum, also makes an adjustment based on temperature influences. Such systems are used in automotive engineering, in particular in regulating the cold and hot air in internal combustion engines.

In accordance with another embodiment of the invention, the drive rod is supplemented by an articulated joint. It is of course also possible to provide a two-part or multipart articulated joint, so that even complex movement processes can be implemented with this vacuum unit. If the longitudinal guide is provided with a suitable sealing element, the vacuum chamber may be sealed by the longitudinal guide and no additional sealing elements are necessary. The entire system is enclosed in a housing, preferably made of plastic. This housing is designed in two parts. The two parts may be joined by snap connections or by a weld with the edges of the diaphragm embedded in the plane of separation of the two parts.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be explained in further detail hereinafter with reference to illustrative preferred embodiments shown in the accompanying drawing figures in which.

DETAILED DESCRIPTION OF PREFERRED EMBODIMENTS

Figure 1:
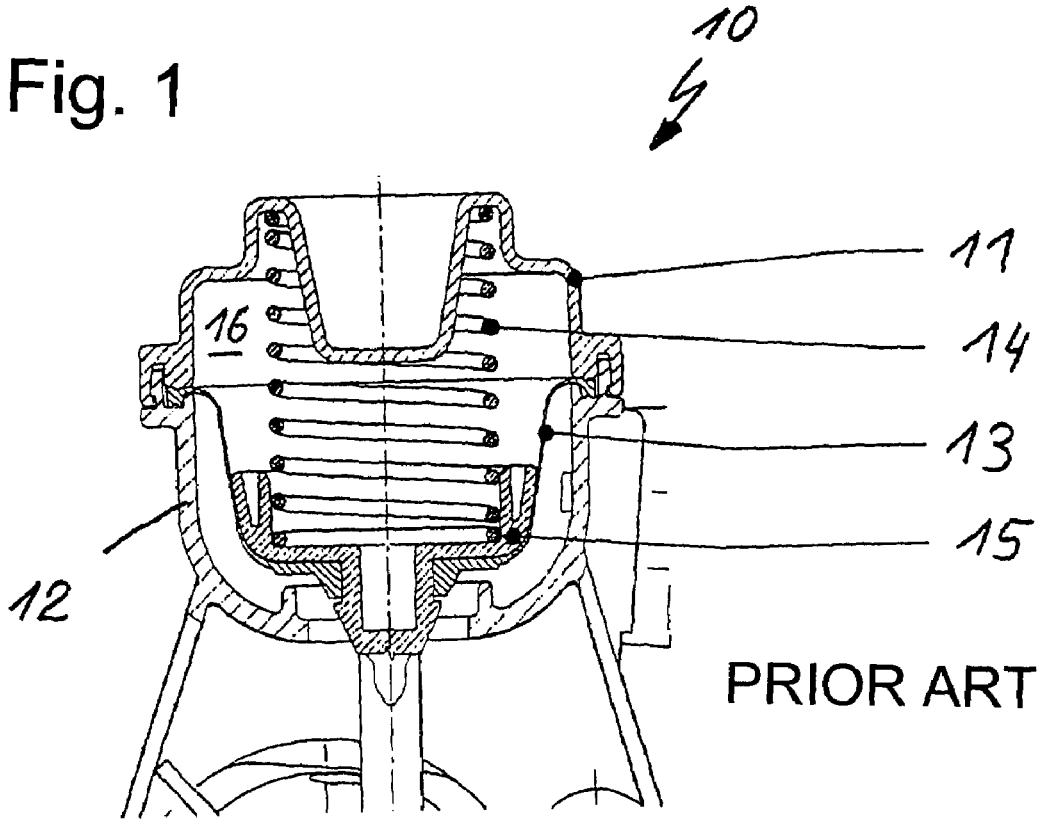
FIG. 1 is a schematic sectional view of a vacuum unit according to the state of the art.

FIG. 1 shows a vacuum unit 10, comprising a cover 11, a housing 12, a diaphragm 13 situated in the housing, a compression spring 14 and a drive rod 15. The compression spring 14 directs a force against the drive rod 15. When a vacuum prevails in the vacuum chamber 16 defined by the housing and diaphragm, the drive rod is pulled inward. When the vacuum is reduced, the drive rod slides outward and may thus adjust an element (not shown here) in the form of a valve, a shaft or the like. The drive rod is surrounded by the diaphragm 13. The connection between the diaphragm and the drive rod is selected so that it also forms a seal for the vacuum chamber 16 at the same time. It can be seen here that with a force acting laterally on the drive rod, the latter tends to yield, i.e., there are problems with regard to the guidance due to the instability of the spring. This may result in the drive rod rubbing on the housing or it may become skewed, thus resulting in inaccuracies and improper positioning.

Figure 2:
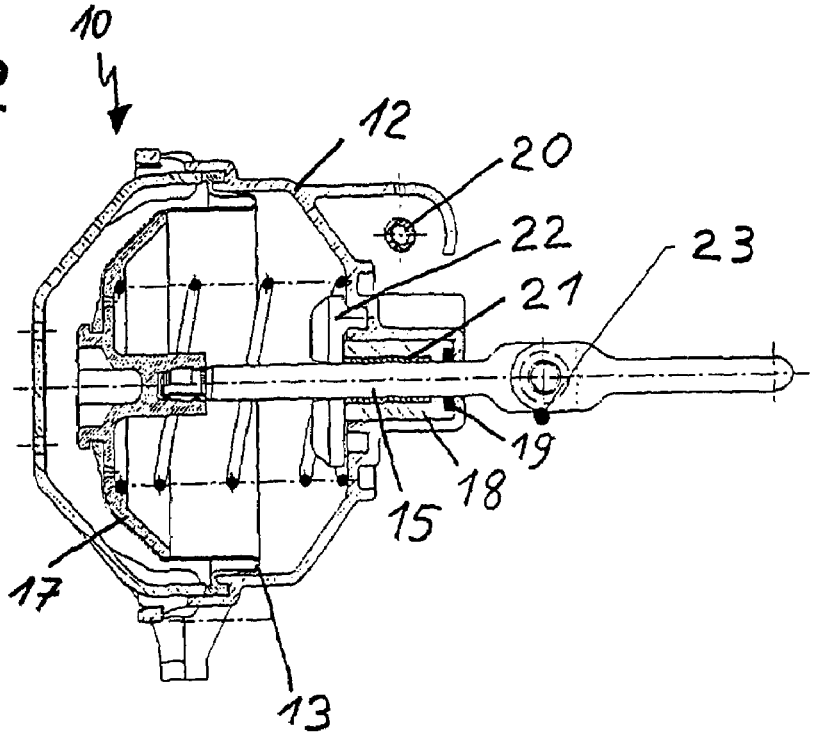
FIG. 2 is a schematic sectional view of a vacuum unit having a longitudinal guide and an articulated joint.

FIG. 2 shows a vacuum unit 10 with a longitudinal guide. Corresponding same parts are labeled with the same reference numerals. The drive rod 15 is provided with a drive rod head 17, with which the diaphragm 13 is in sealing contact. At the passage of the drive rod 15 through the housing 12, a longitudinal guide is provided in the form of a slide or friction bearing 18. This slide bearing has a gasket 19 which ensures that the vacuum chamber 16 is reliably sealed. The vacuum chamber is connected by a line 20 to a vacuum generator (not shown here). The slide bearing has a friction bearing bushing 21, the material of which is coordinated with the material of the drive rod and has a low coefficient of friction. The slide bearing is also provided with a bearing cover 22, which simultaneously serves as a stop for the drive rod head 17 at a maximum vacuum. An articulated joint 23 is provided on the drive rod, so that a crank can be driven with this system. There is also the possibility of executing a pivoting or swiveling movement, so that an additional articulated joint is not needed in the drive rod.

Figure 3:
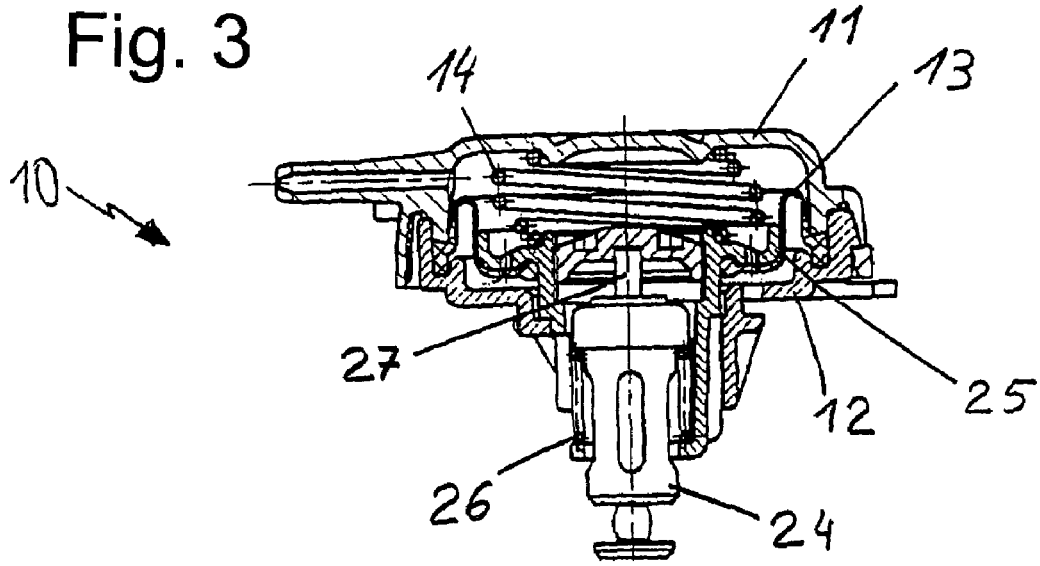
FIG. 3 is a schematic sectional view of a vacuum unit having a thermally expandable element.

FIG. 3 shows a vacuum unit having an additional thermally expandable element 24. Such thermally expandable elements are also known as "Wax Thermostats." They execute an axial movement when there are changes in temperature. The thermally expandable element itself is axially movable, mounted in the housing 12 of the vacuum unit in such a way that a plastic carrier 25 which is connected to the diaphragm 13 moves this element because of the applied vacuum. If a change in temperature also occurs, the thermally expandable element 24 will execute an axial movement against the force of the compression spring 26 because the plunger 27 of the thermally expandable element is supported on the plastic carrier 25.

Figure 4:
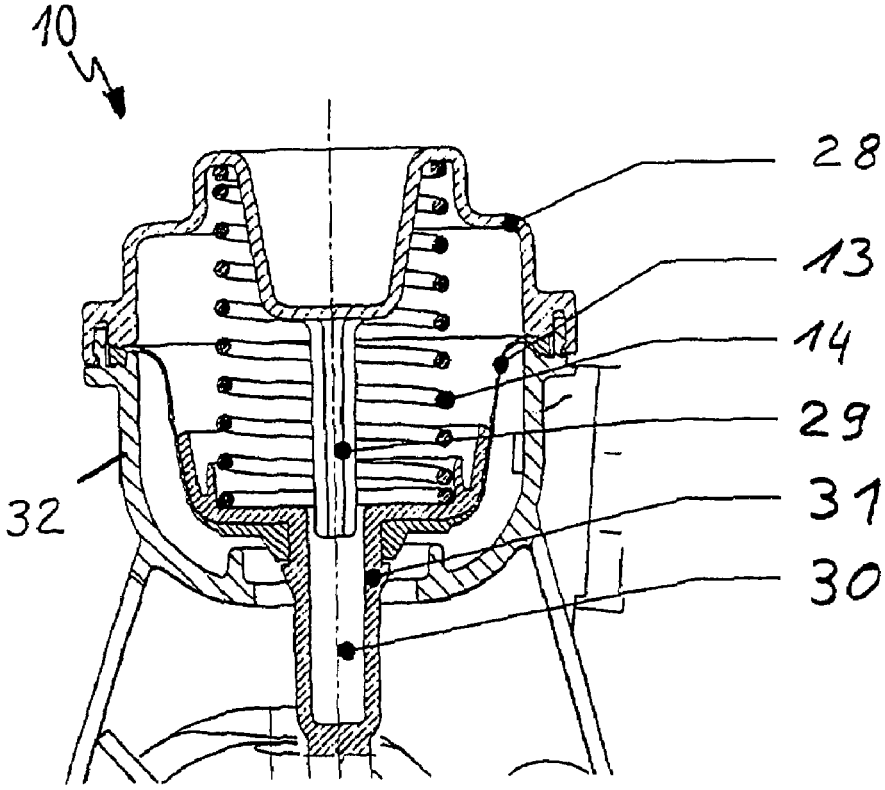
FIG. 4 is a schematic sectional view of a vacuum unit having a bearing pin.

FIG. 4 shows a variant in which the cover 28 is provided with an inwardly directed bearing pin 29. This bearing pin 29 engages in a borehole 30 in the drive rod 31 and thus serves as a guide for the drive rod, which means that guidance via the housing 32 in the area where the drive rod passes through the housing is unnecessary. Of course, the drive rod may be guided by both the plunger 29 and a friction bearing guide or a linear ball bearing guide. The advantage of the bearing pin guide is that the housing may have a relatively simple design and soiling of the guide due to the plunger on the inside is effectively prevented. Another advantage is that the drive rod is not in contact with the housing wall and the diaphragm cannot be torn. By providing adequate play in the guide, the vacuum unit shown in FIG. 4 may also drive a crank such as those conventionally used for vacuum drives for rotary slide valves, e.g., on the intake systems of internal combustion engines, without requiring an additional articulated joint in the drive rod. It is advantageous that the guide is mounted on the most remote point from the crank drive, thereby minimizing the angular deflection of the drive rod.

FIG. 4 also illustrates how the housing is constructed in two parts, e.g., of synthetic resin material (i.e., plastic) which may be welded together with the edges of the diaphragm embedded between them.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A vacuum unit for producing a stroke movement due to an applied vacuum, said vacuum unit comprising a housing, a spring situated in said housing, a diaphragm and a drive rod arranged on the diaphragm, wherein the drive rod is centered on the diaphragm and is mounted in the housing of the vacuum unit by a longitudinal guide, wherein the housing has a bearing pin, and said bearing pin engages in a borehole in the drive rod and forms the longitudinal guide.

2. A vacuum unit according to claim 1, wherein the longitudinal guide is a slide bearing.

3. A vacuum unit according to claim 1, wherein the housing and diaphragm define a vacuum chamber which extends to the longitudinal guide.

4. A vacuum unit according to claim 1, wherein the housing is made of synthetic resin material and is constructed in two parts which are welded together with the diaphragm embedded in the joint between them.

5. A vacuum unit according to claim 1, wherein the drive rod comprises a thermally expandable element.

6. A vacuum unit according to claim 1, further comprising an articulated joint on the drive rod for driving a crank.

7. A vacuum unit according to claim 1, further comprising an articulated joint on the drive rod for executing a pivoting movement.

* * * * *